US010580295B2

(12) United States Patent
Albornoz

(10) Patent No.: US 10,580,295 B2
(45) Date of Patent: Mar. 3, 2020

(54) VEHICULAR SAFETY SYSTEM

(71) Applicant: FUJITSU LIMITED, Kawasaki-shi, Kanagawa (JP)

(72) Inventor: Jose Albornoz, Iver Heath (GB)

(73) Assignee: FUJITSU LIMITED, Kawasaki (JP)

( * ) Notice: Subject to any disclaimer, the term of this patent is extended or adjusted under 35 U.S.C. 154(b) by 553 days.

(21) Appl. No.: 14/674,631

(22) Filed: Mar. 31, 2015

(65) Prior Publication Data

US 2015/0310742 A1 Oct. 29, 2015

(30) Foreign Application Priority Data

Apr. 29, 2014 (EP) ..... 14166473

(51) Int. Cl.
*G08G 1/0967* (2006.01)
*G08G 1/16* (2006.01)

(52) U.S. Cl.
CPC ..... *G08G 1/0967* (2013.01); *G08G 1/096716* (2013.01); *G08G 1/096791* (2013.01); *G08G 1/163* (2013.01)

(58) Field of Classification Search
CPC ..... G08G 1/161
See application file for complete search history.

(56) References Cited

U.S. PATENT DOCUMENTS 4,591,823 A 5/1986 Horvat
7,333,026 B2 2/2008 Hunzinger
(Continued)

FOREIGN PATENT DOCUMENTS

CN 202217395 U 5/2012
GB 2458513 A 9/2009
(Continued)

OTHER PUBLICATIONS

"Part 11: Wireless LAN Medium Access Control (MAC) and Physical Layer (PHY) Specifications", IEEE Computer Society, Jun. 27, 2003.
(Continued)

*Primary Examiner* — Joseph H Feild
*Assistant Examiner* — Pameshanand Mahase
(74) *Attorney, Agent, or Firm* — Staas & Halsey LLP

(57) ABSTRACT

A vehicular safety system employing an adaptive epidemic information dissemination protocol running on a wireless ad-hoc network composed by neighboring vehicles and roadside stations. The protocol is based on storage and re-transmission of messages by vehicle on-board units; both storage time and re-transmission period are adaptively adjusted to make information spread through the network reasonably certain. An on-board vehicle system monitors a speed and acceleration to detect collisions or any other dangerous situations that might compromise the safety; when such an event is detected a time-stamped message identifies the vehicle and approximate location and event type. A panic button can trigger an emergency message in an immediate threat situation. Roadside stations add their location to the messages they relay; they also receive messages transmitted from passing vehicles, relaying them to law-enforcement agencies. Roadside stations can also broadcast messages aimed at locating and safely disabling stolen vehicles.

4 Claims, 5 Drawing Sheets

(56) References Cited

U.S. PATENT DOCUMENTS

| | | | | |
|---|---|---|---|---|
| 8,068,016 | B2 | 11/2011 | Toh | |
| 8,515,654 | B2 | 8/2013 | Turner et al. | |
| 2002/0152026 | A1* | 10/2002 | Evans | G01C 21/26 701/415 |
| 2008/0119966 | A1* | 5/2008 | Breed | G07C 5/008 701/2 |
| 2009/0063030 | A1* | 3/2009 | Howarter | G08G 1/096783 701/117 |
| 2009/0081958 | A1* | 3/2009 | McNew | H04B 17/382 455/69 |
| 2009/0243883 | A1 | 10/2009 | Simon | |
| 2010/0188265 | A1* | 7/2010 | Hill | G08G 1/0104 340/905 |
| 2010/0227593 | A1 | 9/2010 | Myr | |
| 2011/0038356 | A1* | 2/2011 | Bachrach | H04W 72/1231 370/337 |
| 2011/0128849 | A1 | 6/2011 | Guo | |
| 2012/0108163 | A1 | 5/2012 | Bai et al. | |
| 2012/0146812 | A1 | 6/2012 | Ruy | |
| 2013/0138267 | A1 | 5/2013 | Hignite et al. | |

FOREIGN PATENT DOCUMENTS

| | | | |
|---|---|---|---|
| WO | WO 98/49664 | A1 | 11/1998 |
| WO | WO 2008/092475 | A1 | 8/2008 |

OTHER PUBLICATIONS

"Part 15.3: Wireless Medium Access Control (MAC) and Physical Layer (PHY) Specifications for High Rate Wireless Personal Area Networks (WPANs)", IEEE Computer Society; Sep. 29, 2003.

"Part 15.4: Wireless Medium Access Control (MAC) and Physical Layer (PHY) Specifications for Low-Rate Wireless Personal Area Networks (WPANs)", IEEE Computer Society, Sep. 8, 2006.

Mehar, Sara; "Dissemination Protocol for Heterogeneous Cooperative Vehicular Networks", IEEE 2012.

European Search Report dated Jul. 23, 2014 in corresponding European application 14166473.0.

* cited by examiner

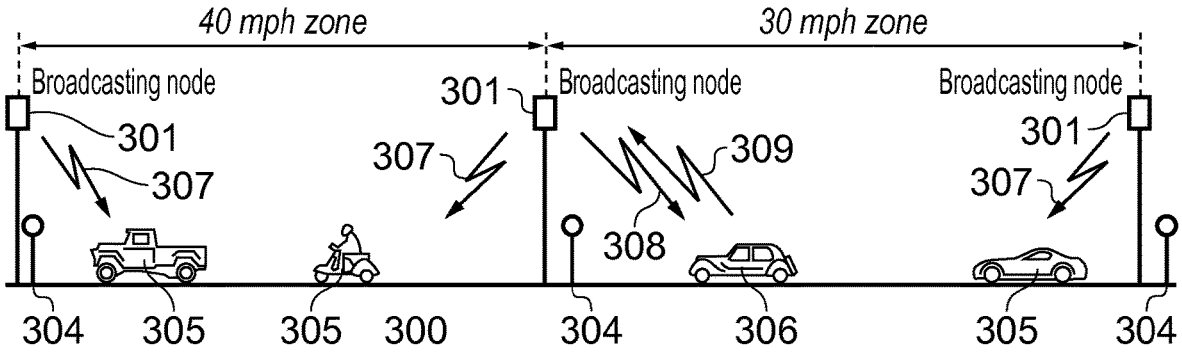
FIG. 3
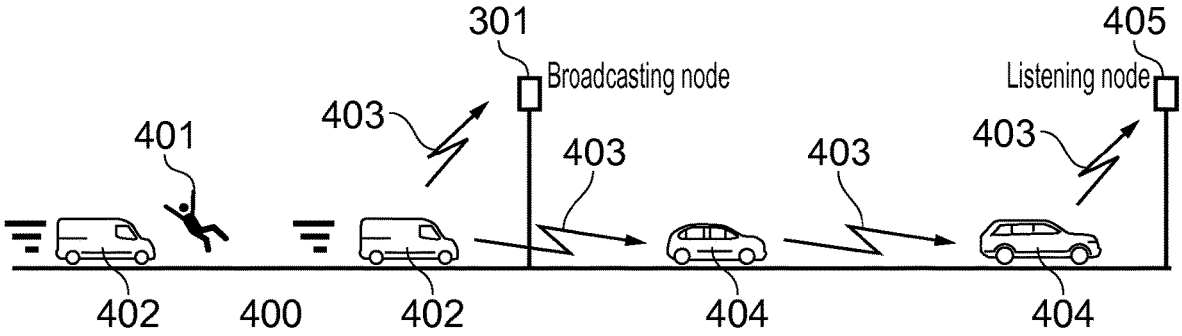
FIG. 4
500
| Preamble | Speed limit & position data | Additional information/query flag | Data |
|---|---|---|---|
| 501 | 502 | 503 | 504 |
FIG. 5
600
| Preamble | ID Data | Time and place data | Additional data |
|---|---|---|---|
| 601 | 602 | 603 | 604 |
FIG. 6

VEHICULAR SAFETY SYSTEM

CROSS-REFERENCE TO RELATED APPLICATIONS

This application claims the benefit of European Application No. 14166473.0, filed Apr. 29, 2014, in the European Intellectual Property Office, the disclosure of which is incorporated herein by reference.

BACKGROUND

1. Field

The present invention relates to apparatuses, systems and methods for disseminating information pertaining to vehicular safety, in order to alert traffic authorities and road users about situations that compromise driver and passenger safety, or generate a road hazard such as stolen/hijacked vehicles, dangerous driving, burning vehicles or collisions.

2. Description of the Related Art

Each year some 50 million people are injured in traffic accidents worldwide, with 1.3 million dying as a result: this figure is greater than the yearly number of persons dying from malaria. Traffic accidents also have significant economic consequences, accounting for global yearly losses in the range of US$500 billion. Among traffic accident statistics, hit-and-run incidents are noteworthy since a large proportion of them remain unsolved: in 2004 there were 23,714 hit-and-run incidents in the UK with 145 fatalities, and without information from witnesses, the public or street cameras there is very little that can be done to find the culprits. Other traffic-related offences such as stolen vehicles also have an impact in terms of monetary losses: in 2011 alone 65,000 vehicles—worth an estimated £300 million—were stolen and never recovered.

Current devices and systems aimed at improving road safety such as CCTV, speed limiters, vehicle detection, radar/lidar or vehicle tracking devices suffer from limitations such as lack of system-wide real-time alerts, possible vehicle misidentification, or excessive cost due to reliance on human operators or technologies such as GPS or mobile phone networks. Additionally, some of these systems require human operation and interpretation, introducing additional costs as well as possible human error. Besides, in circumstances such as in hit-and-run incidents there are often no systems or human operators in place to record the occurrence of such an event.

In view of these problems it would be highly desirable to have the means to: a) provide automated, real-time warnings to drivers and road safety agencies about events that endanger road users, with the possibility of uniquely identifying involved vehicles; b) generate urgent alerts in situations that represent an immediate threat to the physical integrity of driver and passengers; c) provide evidence that can be correlated with incident reports generated by witnesses and traffic authorities; and d) help to locate and safely disable stolen vehicles.

SUMMARY

Additional aspects and/or advantages will be set forth in part in the description which follows and, in part, will be apparent from the description, or may be learned by practice of the invention.

Embodiments of the proposed invention address these needs by proposing a collaborative traffic safety system that depends on the creation of collective intelligence by the exchange and storage of short wireless messages between vehicles and roadside stations through an adaptive epidemic information spread protocol. These messages provide information about events that compromise the safety of drivers and passengers, or represent a hazard to other road users such as sudden decelerations associated with collisions, dangerous driving, excessive speed, erratic driving, burning vehicles, stolen or hijacked vehicles, hit-and-run accidents, etc. The data transmitted in these messages describe the type of event, its time of occurrence and approximate location of the event, and optionally, information that identifies the vehicle. The proposed system can also be used to locate and/or safely disable stolen vehicles.

According to a first aspect of the present invention, there is provided a vehicular safety system in which vehicles in the same geographical area form nodes of a wireless ad-hoc network for transmitting and re-transmitting messages, operating parameters of the ad-hoc network being adaptively adjusted in accordance with driving conditions of the vehicles, and where the operating parameters being adjusted include a retransmission interval at which to repeat transmission of the messages, where:

the operating parameters being adjusted further include a retransmission time after which to cease retransmission; and in that the driving conditions of a vehicle include at least one of:

a time of day and/or day of the week;

a type of road on which the vehicle is being driven; and whether the vehicle is parked.

The operating parameters may be further adaptively adjusted in accordance with a priority associated with each message. Thus, the retransmission interval may be reduced, and/or the retransmission time extended, for messages of higher priority.

The system as defined above may further comprise a plurality of roadside nodes of the ad-hoc network. These roadside nodes preferably include listening nodes for receiving the messages, and preferably also include broadcasting nodes for at least transmitting messages to the vehicles, the messages including location information.

In the above system, preferably, at least some of the roadside nodes are arranged for forwarding messages to a traffic control centre and/or emergency response centre.

Each vehicle as referred to above may be arranged for:

detecting one or more states of the vehicle to generate messages;

transmitting messages at least to other vehicles;

receiving messages at least from other vehicles; and storing generated and received messages at least for the duration of a retransmission time.

With a vehicle so arranged, the detected states of the vehicle may include at least one of:

the speed of the vehicle;

sudden deceleration of the vehicle;

temperature of the engine;

deployment of an air bag;

sudden loud noise in the vehicle;

actuation of a panic button.

In this case, preferably, the vehicle includes a processing and communication unit adapted to determine an emergency or distress situation on the basis of the detected states of the vehicle. That is, although individual ones of the detected states as enumerated above may not indicate any problem, a combination of, for example, a sudden deceleration and a sudden loud noise and/or air bag deployment may be indicative of a collision.

Each generated message preferably includes a time stamp, approximate location, indication of one or more detected states including, if determined, an emergency or distress situation, optionally, a priority level associated with the message, and optionally, an identifier of the vehicle.

According to a second aspect of the present invention, to enable vehicles to participate in the above ad-hoc network there is provided a processing and communication unit for a vehicle, comprising:

detectors for one or more states of the vehicle;

a control unit for generating messages based on the states detected;

a transceiver for transmitting messages at least to other vehicles and receiving messages at least from other vehicles as part of an ad-hoc network; and a memory for temporarily storing generated and received messages;

where the processing and communication unit is configurable with a retransmission interval at which to repeat transmission of the messages, and a retransmission time after which to cease retransmission, the retransmission interval and retransmission time being adaptively adjusted in the ad-hoc network.

In the above processing and communication unit, preferably, the memory is arranged to store messages for a retransmission time with which the processing and communication unit has been configured, the retransmission time being adaptively adjusted in the ad-hoc network as already mentioned.

Preferably also, the control unit is configured to combine the states detected from the sensors to determine an emergency or distress situation with respect to the vehicle.

According to a third aspect of the present invention, there is provided a vehicle equipped with the processing and communication unit defined above.

According to a fourth aspect of the present invention, there is provided an ad-hoc transmission method for vehicle safety information, comprising:

constituting nodes of the ad-hoc network from a plurality of vehicles operating in a geographical area for transmitting and re-transmitting messages, and adjusting operating parameters of the ad-hoc network adaptively in accordance with driving conditions of the vehicles, where the operating parameters being adjusted include a retransmission interval at which to repeat transmission of the messages, where:

the operating parameters being adjusted further include a retransmission time after which to cease retransmission; and in that the driving conditions of a vehicle include at least one of:

a time of day and/or day of the week;

a type of road on which the vehicle is being driven; and whether the vehicle is parked.

Thus, embodiments of the present invention provide a method, an apparatus and system to disseminate information relating to vehicular safety in a traffic system (road network). The system is based on an adaptive epidemic information dissemination protocol that mimics the spread of an infectious disease through an ad-hoc network composed by neighbouring vehicles and roadside stations. In the event of a hazardous or illegal event (e.g. a collision or stolen/hijacked vehicle) a time-stamped short message that optionally identifies the vehicle and that contains data describing the type of event and/or message priority and its approximate location is transmitted periodically by an on-board system. This message is received and relayed by roadside stations and/or by other vehicles. Messages received by neighbouring vehicles are stored and re-transmitted periodically; both message storage time and re-transmission period are adaptively adjusted in order to make information spread through the network reasonably certain. Messages received by roadside stations are relayed to emergency services and traffic authorities. Roadside stations may also broadcast messages containing their position that are received by passing vehicles, therefore making GPS or other positioning systems unnecessary. In addition, the roadside stations may broadcast messages aimed at locating and safely disabling stolen vehicles. Benefits of the invention include: a) to enhance road safety; b) to curb the number of fatalities and/or injuries associated with traffic accidents; and c) to reduce the monetary costs related to traffic accidents and stolen vehicles.

BRIEF DESCRIPTION OF THE DRAWINGS

Reference is made, by way of example only, to the accompanying drawings which are as follows.

FIG. 3: Communication model between on-board nodes and roadside broadcasting nodes.

FIG. 4: Vehicle-roadside node and vehicle-vehicle communication model.

FIG. 5: Exemplary structure of messages transmitted from broadcasting stations.

FIG. 6: Exemplary structure of messages transmitted from on-board nodes.

DETAILED DESCRIPTION

Figure 1:
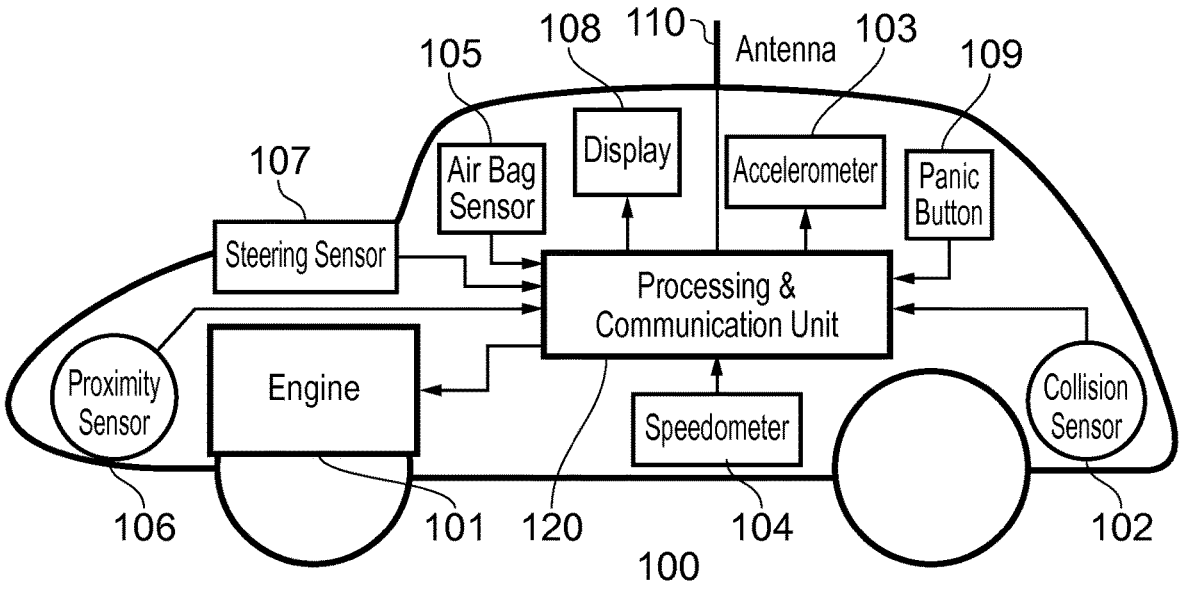
FIG. 1: An exemplary embodiment of the vehicular on-board system.

Reference will now be made in detail to the embodiments, examples of which are illustrated in the accompanying drawings, wherein like reference numerals refer to the like elements throughout. The embodiments are described below to explain the present invention by referring to the figures.

Traditional road safety schemes involve watchful police officers using radar/lidar technology and/or fixed/portable roadside cameras; the successful use of some of these measures depends on an adequate illumination of the scene and for this reason they are not reliable during night-time or in adverse weather.

Schemes have been proposed for automatically detecting and reporting events that can in principle endanger other road users such as speed limit violations; however, these do not take into account other situations that create a hazard, such as sudden decelerations or collisions with another vehicle or with a pedestrian. Conventionally, the tasks of locating hazards and supplying relevant information about them to drivers and authorities have been addressed by using on-board systems that depend on GPS positioning, digital map technology, or other location technologies that employ the mobile telephony system: these solutions are costly, greatly increasing the complexity of the on-board system. Another solution is to employ roadside stations broadcasting this information; however this requires a large number of such stations deployed along roads, with the consequent impact on system costs and complexity.

Recently, attention is being given to implementing vehicular ad-hoc networks (VANETs) to disseminate road-related information. To date, proposals in this area are not adaptive to driving conditions and do not provide collective information storage, and therefore their capabilities are limited by the availability of communication links to other nodes at the location and time of an event: if there are no neighboring nodes, information about the event is lost.

The present invention addresses these shortcomings by proposing a traffic safety system based on the generation of collective intelligence through an adaptive epidemic information spread protocol running on a vehicular ad-hoc network. Operating parameters of the ad-hoc network are adaptively adjusted in accordance with driving conditions of vehicles and optionally, in accordance with a priority of each message. Each node of the network is composed of an on-board system that senses, amongst other possible variables, a vehicle's speed and acceleration as well as any other signal that may be associated to situations that compromise the safety of the driver and passengers or that generate a hazard to other road users.

An exemplary embodiment of this on-board system is depicted in FIG. 1. A processing and communication unit 120 installed on a vehicle 100 receives information from one or more collision sensors 102 that could be installed in the bonnet, bumpers, and doors of the vehicle, one or more accelerometers 103, a speedometer 104, one or more air bag deployment sensors 105, one or more proximity sensors 106, and a steering sensor 107. All items 102-107 are referred to as "sensors" below. Other sensors or measuring devices (not shown), conventionally provided in relation to the vehicle may also be coupled to the processing and communication unit, for example a temperature sensor, fuel gauge, and revolution counter. The processing and communication unit may further be linked with an engine management system if present, and/or with individual control systems or actuators for the engine and other vehicle components. The processing and communication unit may also be coupled to the braking system (including handbrake), not necessarily only for receiving a sensor measurement but also for transmission of control signals as explained below. Use may also be made of a microphone, perhaps one already provided as part of a hands free installation, to detect the audio level within the vehicle. The processing and communication unit may also be linked to a positioning system provided in the vehicle, if available.

The processing and communication unit 120 (also referred to as an "on-board unit") transmits and receives short messages through the antenna 110. By receiving messages, the processing and communication unit gains information relating to the traffic environment, which it can process to provide information about speed limits and road hazards for display to the driver through display 108. One or more panic buttons 109 are also provided for use of the driver and passengers to signal distress and emergency situations; these buttons could be located in places such as the steering wheel, dashboard, footwell, or the boot or trunk.

Figure 2:
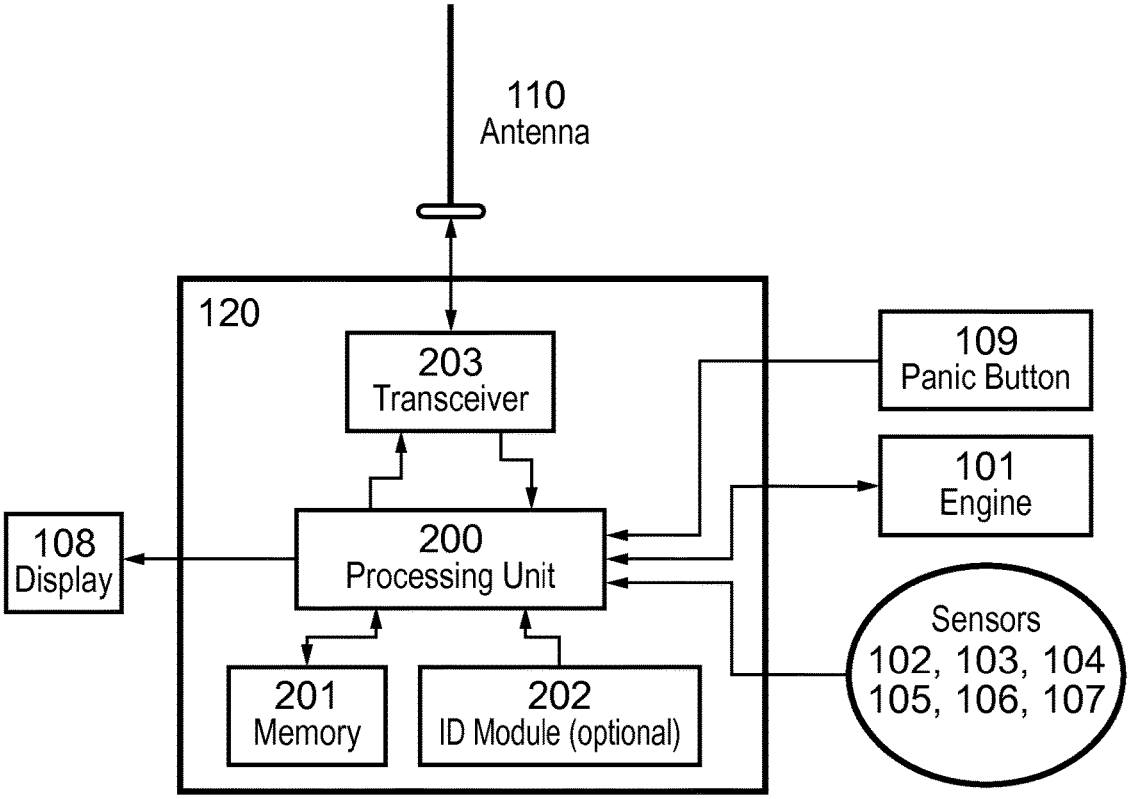
FIG. 2: An exemplary embodiment of the processing and communications unit.

FIG. 2 shows an exemplary embodiment of the processing and communication unit 120, containing a processing unit 200, memory 201, an optional ID module 202, and a transceiver 203. The processing unit 200 receives information from available information sources including the collision sensors 102, accelerometers 103, speedometer 104, air bag deployment sensor 105, proximity sensors 106 and steering sensor 107 to determine if an event such as a sudden acceleration, deceleration, or collision has occurred. The processing unit 200 will also receive signals from panic buttons 109 in the event that any occupant of the vehicle signals a distress situation. The transceiver 203 emits and receives messages through the antenna 110 under control of the processing unit 200. Memory 201 stores messages received by the antenna 110 via transceiver 203, in other words, messages received from units in neighbouring cars or from roadside stations. It also stores messages prepared by the processing and communication unit to be sent to transceiver 203 and transmitted via the antenna 110 to other vehicles or roadside stations. Messages are stored in memory 201 at least until expiry of a "retransmission time" explained below.

The optional ID module 202 contains information that uniquely identifies the vehicle carrying the on-board system such as registration number, serial number, insurance cover validity, owner details, and the like. This information is added to every message transmitted by transceiver 203 and antenna 110 only if the user chooses to enable this option; otherwise, the processing unit 200 adds a random code to each transmitted message, which uniquely identifies the vehicle while maintaining its anonymity. Possible incentives for enabling the ID module 202 could be increased personal safety, reduced car insurance premiums, protection against vehicle theft, or fleet management.

The display unit 108 informs the driver about speed limits, and presents information about hazards in the area, as will be later detailed in this disclosure.

The communication link illustrated in FIG. 2 between the processing unit 200 and the engine 101 denotes exchange of information with sensors/measuring devices and actuators/controls of the engine. This link serves various purposes. Firstly, the processing and communication unit is able to interrogate devices to report their state (where reports are not configured to be made automatically). Sensors or measuring devices on the engine may be configured to report to the processing and communication unit at intervals, or in response to a measurement exceeding a predetermined threshold. For example, the presence of fire in the engine compartment can be detected by use of a temperature sensor and reported to the processing unit 200.

Secondly, the processing and communication unit can influence the operation of the vehicle by transmitting control messages. For example a control message generated by the processing and communication unit and sent to the engine actuators (fuel injection system, brakes etc.) either directly or via an on-board engine management system, can safely disable the vehicle (for instance by gradually reducing fuel supply, applying the brakes and activating emergency lights) upon reception of a specific message if the vehicle is stolen or hijacked. A further possibility is to disable the vehicle in case of tampering with the processing and communication unit 120.

The communication model involves ad-hoc communication between on-board vehicular nodes and between the vehicle nodes and two types of roadside nodes: broadcasting nodes and listening nodes. Broadcasting nodes are installed in places where there is a transition between different speed limit zones or at traffic bottlenecks such as roundabouts or traffic lights; therefore the number of nodes required to provide the necessary functionality is substantially smaller as compared to the prior art.

One role of broadcasting nodes is to broadcast short messages containing the speed limit in force for the zone and the node's location, making positioning technologies such as GPS or digitized maps unnecessary since vehicles receiving these messages store the node's location data to record their presence in the zone served by the node. Another task of the broadcast nodes is to transmit messages aimed at alerting drivers about road hazards as well as detecting and disabling stolen/hijacked vehicles. In addition, the broadcasting nodes are preferably equipped to receive messages from passing vehicles such as road event related data, distress messages, or replies to queries to emergency services or traffic authorities, and to forward such messages to a control center as explained below.

Roadside listening nodes are installed in places other than transitions between different speed limit zones: as their name implies, their only role is to receive messages about road events or emergencies transmitted by passing vehicles and relay them (either wirelessly to the next node, or via a backhaul network) to emergency services or traffic authorities. If there are stretches of road lacking either type of roadside node (for example, in undeveloped areas), the vehicles may still relay messages among themselves until one or more vehicles come within range of the next roadside node.

FIG. 3 illustrates these concepts on a stretch of road 300 encompassing two different speed zones. Broadcasting nodes 301 transmit short messages 307 that are received by vehicles 305 and 306; these messages contain speed limit and location information, therefore supplementing and augmenting the information normally provided by conventional traffic signs 304. As a vehicle receives such a message, its presence in the zone served by a particular broadcasting node 301 is recorded by noting the node's location data in memory 201 of the processing and communication unit 120; at the same time the driver is made aware about the speed limit for the area through the processing and communication unit decoding the message, extracting the speed limit in force in that zone, and alerting the driver to the speed limit via the display 108. Broadcasting nodes separating roads with different speed limits can take advantage of directional antennas in order to send different messages to traffic approaching from opposite directions.

For present purposes, it may be assumed that nodes transmit messages regardless of the presence or absence of other nodes to receive the messages. Alternatively, it could be arranged that to save electrical power, any node in the system only transmits when it has detected another node in some way, for example using a discovery procedure.

In normal circumstances, vehicles 305 do not respond to messages 307 sent by broadcasting nodes; however messages transmitted by broadcasting nodes 301 can also contain information aimed at locating stolen or hijacked vehicles. For example, a broadcasting station 301 may periodically transmit a message 308 containing a query containing ID data for a stolen/hijacked vehicle. Upon reception of a message 308 by a vehicle 306, its processing and communication unit performs a comparison between its own ID data stored in ID module 202 (only if this module 202 has been enabled by the user) and the ID data contained in message 308 and if there is a match, then vehicle 306 sends a reply message 309 to broadcasting node 301, alerting authorities about its presence in the area. Further messages can be then sent from broadcasting nodes 301 to safely disable vehicle 306 by gradually reducing fuel supply to the engine while activating hazard warning lights; these messages can also be relayed by other vehicles, as will be made clear in the subsequent paragraphs. Alternatively the processing and communication unit may disable the vehicle automatically in response to finding an ID match in message 308.

FIG. 4 illustrates the vehicle-roadside node and vehicle-vehicle communication model in an embodiment of this invention. Road events 401 that might generate a hazard such as burning vehicles, collisions, erratic driving, or sudden acceleration/deceleration are detected by the on-board processing and communications 120 unit through sensors 102, 103, 104, 105, 106, and 107 onboard a vehicle 402; similarly, situations that endanger the physical safety of driver and passengers can be signalled to the on-board processing and communication unit 120 through panic buttons 109.

Upon the occurrence of an event 401 the processing unit 200 generates a time-stamped message 403 containing data describing the type of event, its priority (see below), the last location stored in memory 201 or read from a GPS device if present, and, only if the user has chosen to enable ID module 202 in the processing and communication unit 120, ID information for the vehicle.

These messages 403 can be received by broadcasting nodes 301, by listening nodes 405, or by neighbouring vehicles 404. Here, "neighbouring vehicles" refers to vehicles equipped to participate in an ad-hoc network, for example by being equipped with the processing and communication unit referred to earlier. Of course, it is not necessary for all vehicles to join the network. Neighbouring vehicles 404 receive, store and re-transmit these messages in order to alert other drivers about the presence of a hazard or about endangered drivers; road-side nodes receive messages 403 and after adding position information, relay the messages to emergency services and/or traffic authorities. In this way collective intelligence about traffic events is created through a robust adaptive epidemic information spread protocol through the storage and relaying of event messages 403 in the vehicular ad-hoc network.

It will be noted that the processing and communication unit 120 will normally be unable to gain knowledge of a collision, erratic driving and so on directly; usually the processing and communication unit must infer the occurrence of such an event based on the information available to it. For example a sudden deceleration coupled with air bag deployment or a sudden loud audio signal would indicate a collision. Other types of events (such as sudden acceleration/decelerations) might be triggered by very different reasons (e.g. hitting a speed bump versus hitting a pedestrian); therefore certain event messages will only have significance in the context of a report (from other sources) of a serious incident. A feature of the proposed invention is then to provide a record of such events that can be later correlated with in-situ reports. Machine learning techniques can also be used to train the system to distinguish between relevant and irrelevant events.

Here, "events" can either be at a detailed level of vehicle operation or more conceptual (and potentially more serious). Below, the expression "low level" information is used to refer to sensor information which is reported directly to the processing and communication unit, such as a temperature or sudden deceleration. Generally, an "event" in the form of an isolated item of low level information may not permit any conclusion to be drawn about what has occurred. Depending on system settings and/or configuration of the individual processing and communication unit, such events may or may not be reported to the network by transmission of an event message.

By contrast, "high level" information refers to an event which the processing and communication unit has inferred or learned by combining the available information from the sensors and possibly taking into account information from messages received via the antenna and transceiver. More particularly the high level information may characterise the type of situation which the processing and communication unit has inferred to have happened. High-level information also includes an emergency signalled by the processing unit 200 (such as engine fire) or by the panic button 109. Such events will always be reported to the network by transmitting an event message.

At least the event messages containing high-level information can be assigned a priority level for the purposes of its dissemination through the network. For example, the priority may reflect the severity of the event (e.g. collisions, excessive speed, and sudden decelerations in decreasing order of severity). This may not be appropriate (or a default low priority may be assigned) for event messages containing low-level information. Various levels of priority may be assigned but at a minimum, messages may be designated high-priority or low-priority. The priority level can be used to adjust operating parameters for retransmission of the message as explained below.

For convenience of transmitting messages, events may each be assigned a short numerical code. This may cover both low-level and high-level type of information and may also indicate the priority. For example, the lowest numerical values 0, 1, 2, . . . may be reserved for the most serious high-level events (hijacking, collision, fire . . . ) with higher values such as . . . 125, 126, 127 assigned to low-level events such as sudden braking, activation of hazard warning lights, and so forth. The above mentioned management messages may include messages to configure which events should be disseminated to the network in view of the present density of nodes in the vicinity of the vehicle, the amount of information traffic, and other factors. Thus, for example, vehicle nodes might transmit only messages about events for which the numerical code value is less than a set threshold value.

Both broadcasting and listening nodes 301, 405 may be located on already existing roadside poles (e.g. road lighting or telephone poles) and take advantage of power-line communications and solar/wind power. Listening nodes have a much simpler architecture and could be deployed in greater numbers than broadcasting nodes, which are placed only at locations where speed limits change or at traffic bottlenecks. For wireless communication, a range of tens to hundreds of metres will be appropriate. Those skilled in the art will know of several available wireless communication technologies suitable for the purpose. For example the system can also take advantage of wireless technologies operating in the ISM band such as Wi-Fi (IEEE 802.11) and Bluetooth (IEEE 802.15), or—over a wider spectrum than ISM-Ultra Wide Band (UWB). Communication between roadside nodes and emergency services could take place through fibre optic, microwave line-of-sight communication, the public wired telephone network, or any other suitable long-distance, medium/high bandwidth communication channel.

FIG. 5 shows an embodiment of a message 500 transmitted by a broadcasting node. A preamble field 501 identifies the message as transmitted by a broadcasting node. Field 502 contains data describing the position of the node and the speed limit for the road in which the node is located; this position data contains, or at least implies, information about the type of road to account for the amount of traffic that can be expected. For instance, following the UK road classification the position data could contain M (motorways), A (major trunk roads), B (minor roads) and C (small country roads). A flag field 503 takes any one of a number of different possible values to signal various possible situations. For example: a) no additional information—end of message; b) that additional information that does not require a reply from the on-board unit 120, such as data about road hazards, is included in optional field 504; c) that additional information to query the data stored in the ID module 202 (if enabled), and that might require a reply from the on-board unit 110, is included in optional field 504; d) that the message 500 is a management message to reconfigure the processing and communication unit 120 in some way.

FIG. 6 shows an embodiment of a message 600 transmitted by an on-board node (in other words a vehicle via its processing and communication unit 120). A preamble field 601 identifies the message as transmitted by an on-board node; this preamble also tells receiving nodes if this message is a reply to a query initiated by a broadcasting node or if the message was generated by a road event or a vehicle emergency. Field 602 contains ID data for the vehicle only if the ID module 202 in processing and communication unit 120 is enabled, otherwise this field contains a randomly generated code that uniquely identifies a vehicle without disclosing any other specific information about it. Field 603 contains the time at which the message has been generated and the last location data received from a broadcasting node (or received from a positioning system of the vehicle, if present). Field 604 can contain information that describes an event (at least low-level information such as a sudden deceleration, but also, if available, high-level information such as collision etc.) and its associated priority. A numerical code may be employed for this purpose as already mentioned. Alternatively this field may contain a reply to a query from a broadcasting station.

Figure 7:
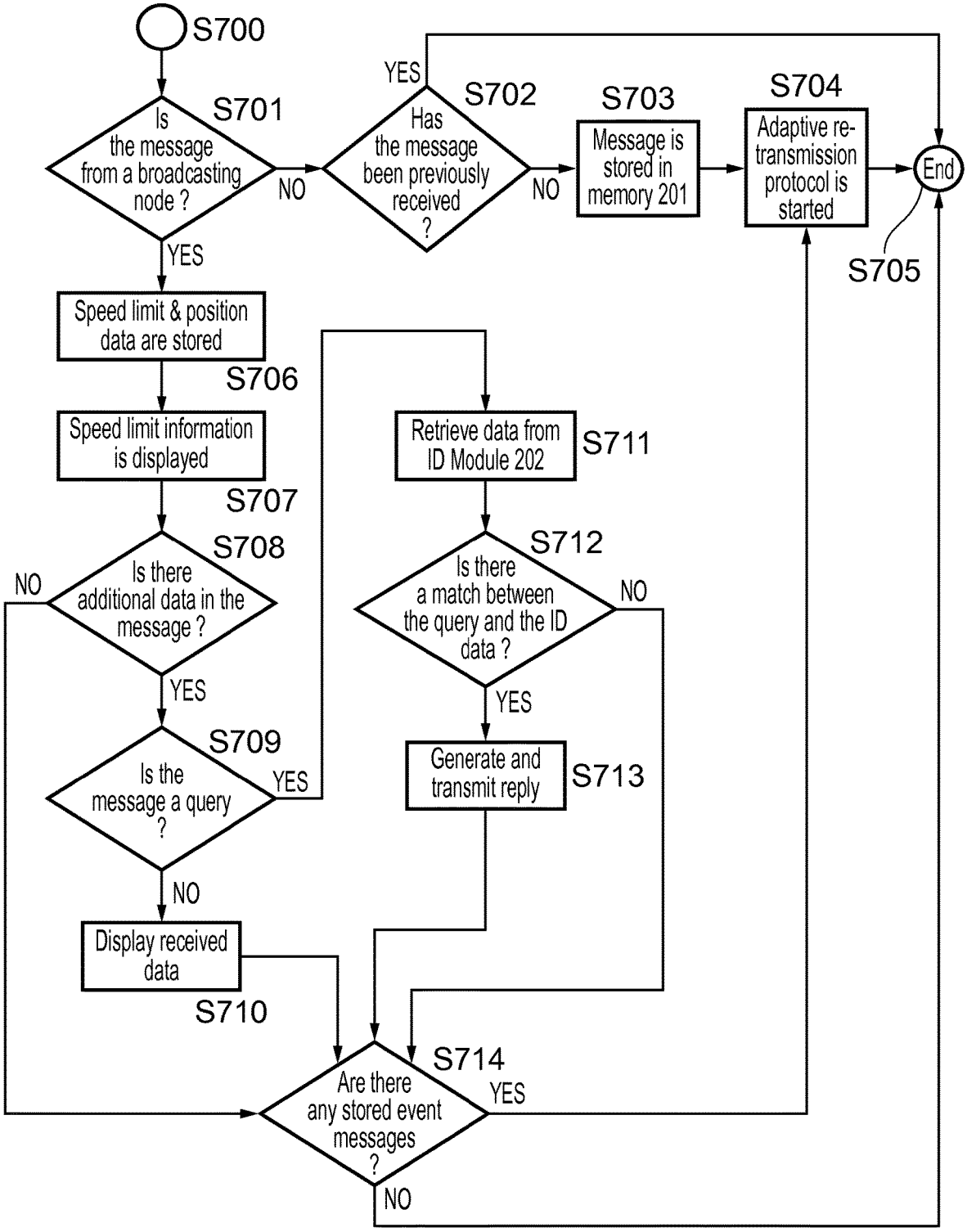
FIG. 7: Exemplary flow diagram describing processing of a message received by an on-board node.

FIG. 7 shows an exemplary flow diagram describing the sequence of actions that take place on an on-board unit 120 when a message has been received. The flow starts at step S700 upon reception of a message and continues at step S701 where the processing unit 200 determines if the message was originated by a broadcasting node; if this is not the case the message was originated by another vehicle, and the flow continues at step S702. At step S702 the processing unit checks for duplicate messages. That is, it determines if the message has already been received, by comparing the ID field 602 of the received message with those already stored in memory 201: if this is the case the message is ignored and the flow ends at step S705. As a variation at this point, instead of merely ignoring the duplicate message, the fact of receiving a duplicate message is used to reduce the priority of the originally-received version (since it can be assumed that the message is already being disseminated in the network). If the message has not been previously received, the flow continues at step S703 and the message is stored in memory 201 within the on-board unit 120. At step S704 an adaptive re-transmission protocol (described below) is started; once this protocol ends, the flow stops at step S705.

If at step S701 the processing unit 200 identifies the message as coming from a broadcasting node, the data in field 502 containing the speed limit for the road and the position of the broadcasting node is stored in memory 201 at step S706. This speed limit information is then shown to the driver by display 108 at step S707. At step S708 the processing unit 200 examines flag 503 in the received message: if there is no additional information the flow continues at step S714. If there is additional information in the message the flow continues at step S709, where the processing unit 200 determines if the additional information represents a query; if that is not the case the information contained in field 504, if it needs to be drawn to the driver's attention, is shown to the driver through display 108 at step S710, and the flow continues to step S714.

If the message is a query that could require a reply, the data that identifies the vehicle is retrieved from ID module 202 at step S711 (only if the ID module 202 in processing and communication unit 110 is enabled) and compared to the data from field 504 at step S712. If the query does not match the information stored in ID module 202, or if the ID module is not enabled, the flow continues at step S714; however if a match is found a reply is generated and transmitted at step S713, with the flow continuing afterwards at step S714. The processing unit 200 determines if there are any stored event messages in memory 201 at step S714: if that is the case these messages are re-transmitted at step S704 according to the adaptive re-transmission protocol mentioned in the preceding paragraph, with the flow ending afterwards at step S705: if there are not any stored messages in memory 201 at step S714 the flow continues at step S705, where the process terminates.

The purpose of the adaptive re-transmission protocol within step S704 is to re-transmit a stored message every T seconds for a length of time L (with L much greater than T); this step is the core of the epidemic information dissemination protocol adopted in embodiments of the present invention. The term "epidemic" is used here because the spread of messages in the network resembles, in mathematical terms, the spread of a disease among a population. Thus, T is a "retransmission interval", such that the same message is repeated at intervals of T, and L is a "retransmission period" within which the message is to be retransmitted with the interval T, but after which that message is no longer transmitted, and may be discarded to free storage space for new messages. Therefore, L may also be viewed as the storage time or lifetime of a message.

It will further be appreciated that, although each individual processing and communication unit has only limited storage capacity at its disposal, collectively the vehicle nodes store all the messages of current interest and this collectively house the "intelligence" of the system without the need for storage of messages elsewhere. It will further be appreciated that transmission of messages in such a network is inherently random and uncertain, as well as leading to duplication of messages; nevertheless it can be made reasonably certain (within a certain percentage probability) that a given message will reach the authorities or other concerned users, by appropriately setting the operating parameters of the network.

The above T and L are examples of such operating parameters. Both T and L can be adaptively adjusted to make the spread of a message through the network reasonably certain according to time of the day, date, type of road in which the vehicle is located and the message priority (either explicit or as implied by type of event that triggered the message). For instance, the values of T and L during rush hour in a motorway for a collision (high-priority message) will be different from those required during night time in a secondary road for a sudden deceleration (low-priority message).

Table 1 illustrates exemplary values for T and L according to the UK road classification scheme for weekday working hours and a low-priority message.

TABLE 1

Exemplary values for T and L

| Vehicle Location | T | L |
|---|---|---|
| Motorway (M) | 1 minute | 0.5 hour |
| Primary Road (A) | 5 min | 1 hour |
| Secondary Road (B) | 15 min | 4 hours |
| Minor Road (C) | 30 min | 12 hours |

The types of Vehicle Location in Table 1 are referred to below as "road types". The values of T and L can be adjusted according to time and date as well as type of event: for instance, default values of T and L could be modified by a given factor accounting for night-time and weekends, with another factor accounting for the message priority. Thus, T would be reduced, and/or L extended, for messages of higher priorities. The default values themselves may be varied over time to reflect, for example, increasing prevalence of roadside nodes and increasing uptake of the system by vehicle manufacturers. This can be done by management messages from the broadcasting nodes. It will also be possible to update T and L more frequently to reflect short-term fluctuations in road traffic density, message load, and so forth.

Figure 8:
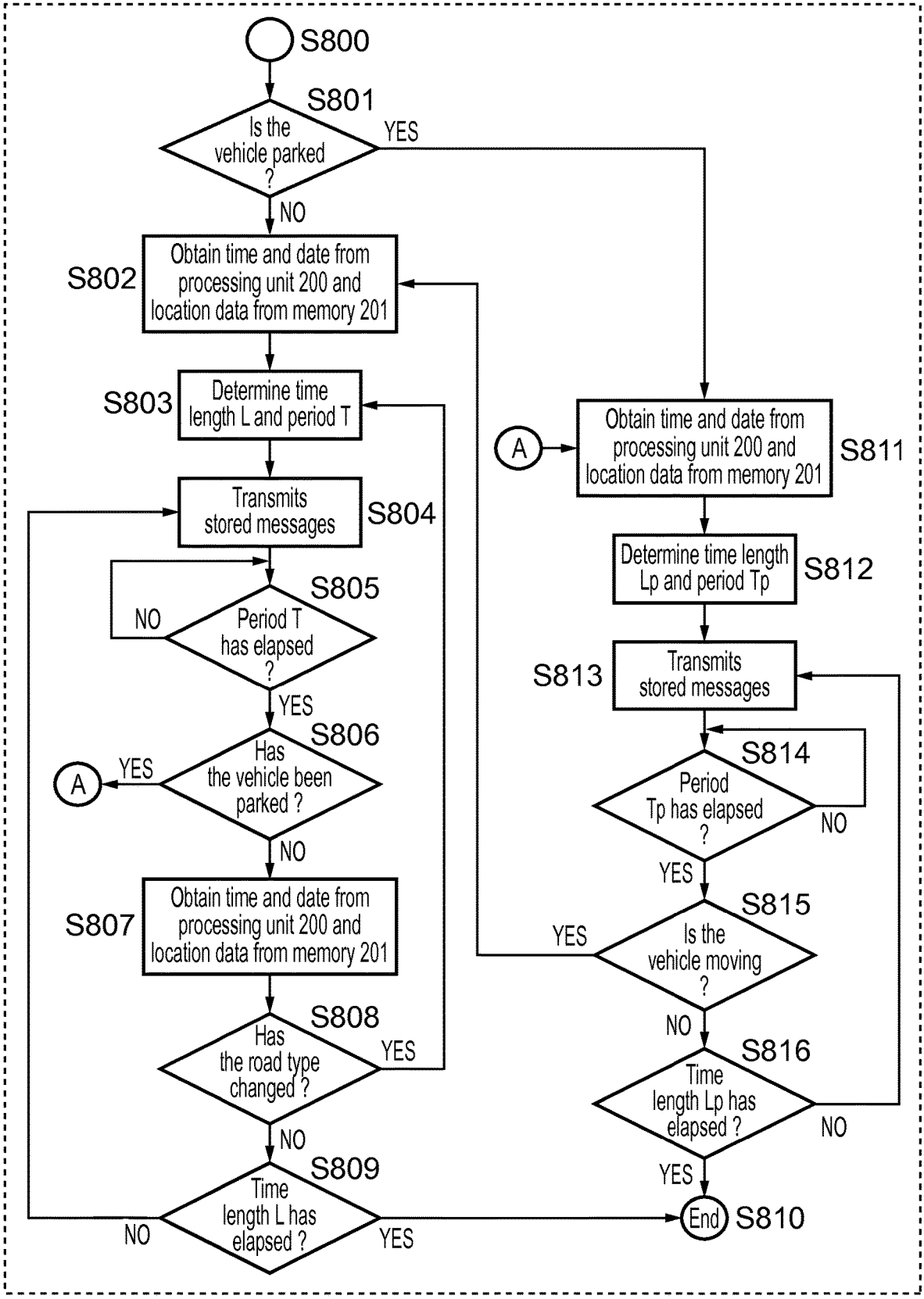
FIG. 8: Exemplary flow diagram describing adaptive message re-transmission protocol for an on-board node.

FIG. 8 shows an exemplary flow diagram describing the adaptive re-transmission protocol contained within step S704. This protocol (or algorithm) is an innovative aspect of embodiments and a key differentiator with respect to prior art. The protocol may be applied either to individual messages, or to multiple messages, including to sets of messages having similar time stamp (where "similar" could mean, for example, within one retransmission interval T). When applied to multiple messages, the messages can be placed in a queue according to their priority, with an execution thread initiated for each message to track separately its transmission through the protocol.

The flow starts at step S800; at step S801 the processing unit 200 verifies if the vehicle is parked. Whether or not the vehicle is parked can be determined, for example, by checking if the handbrake has been applied and the engine is stopped. The engine management system, if present, may be able to provide this information.

On the other hand, if the vehicle is not parked, time, date and location data are obtained from processing unit 200 and memory 201 at step S802. This information is used to compute the times T and L at step S803 with a first transmission of stored messages taking place at step S804; messages with a higher priority such as distress signals are transmitted first. Since the messages shown in FIGS. 5 and 6 will generally be short (i.e. of limited information content), then depending on the wireless communication technology used it may be preferable to send all messages in one burst.

Step S805 delays transmission for a time T; once this time has elapsed the processing system 200 checks whether the vehicle is in the parked state at step S806: if the vehicle has been parked the flow continues at step S811. If that is not the case (implying either that the vehicle is moving, or at least is likely to move shortly), time, date and location data are acquired again at step S807. Then, the processing unit verifies if the road type (see Table 1) has changed at step S808. If the road type remains the same the flow continues at step S809 where the processing system 200 checks if the time L has elapsed since the first transmission (or from the time stamp of the message(s) concerned); if so the flow terminates at step S810, and the message (s) may be deleted or the relevant memory locations allowed to be over-written. On the other hand, if time L has not yet elapsed, another transmission (a retransmission of the same message(s)) takes place at step S804. If the road type is found to have changed at step S808, the flow is re-started at step S803.

If the vehicle is found to be parked at step S801 then time, date and location information are retrieved at step S811. In the case of parked vehicles, the power consumption caused by retransmission of messages may be significant if the vehicle is parked for a long time. For such vehicles, T and L are modified to Tp and Lp respectively (Tp being longer than T, and Lp shorter than L). Values of the period Tp and time length Lp appropriate for a parked vehicle are then computed at step S812; these times will depend on the particular zone where the car is parked (determined from location data) as well as on time and date. The flow continues at step S813 with the transmission of the stored messages according to their priority: at step S814 the transmission is delayed until a time Tp has elapsed. At step S815 the processing system 200 verifies if the vehicle is still parked; if so the flow continues at step S816 where the processing system 200 checks if a time Lp has elapsed since the first transmission (or since the time stamp) at step S812. If the time Lp has elapsed, the flow terminates at step S810; if not the flow is re-started at step S813 where another transmission takes place. If the vehicle is found to be not parked at step S815, the flow continues at step S802.

Messages that are transmitted by the adaptive re-transmission protocol described in the preceding paragraph could be stored in a way that takes care of deleting messages once they have been transmitted. For example each of the processing and communication unit memory 201, broadcasting node 301 and listening node 405 may store messages in a buffer. having a limited capacity such that older messages are automatically discarded after transmission and overwritten by newer ones. The particular data structure used to store messages is not essential but could be, for example, a First In, First Out (FIFO) queue structure with messages arranged in the queue according to priority.

The collective storage, retrieval and periodic re-transmission of messages described so far constitutes an adaptive epidemic dissemination protocol that can provide real-time alerting in situations where traffic density or availability of roadside nodes allows for effective message dissemination; if this is not the case information dispersal will be delayed. In both cases the protocol provides evidence that can be correlated a posteriori with reports of events such as collisions or hit-and-run incidents. This correlation may be made in a control center which receives, in addition to messages spread via the ad-hoc network, other information including police reports and emergency phone calls.

Figure 9:
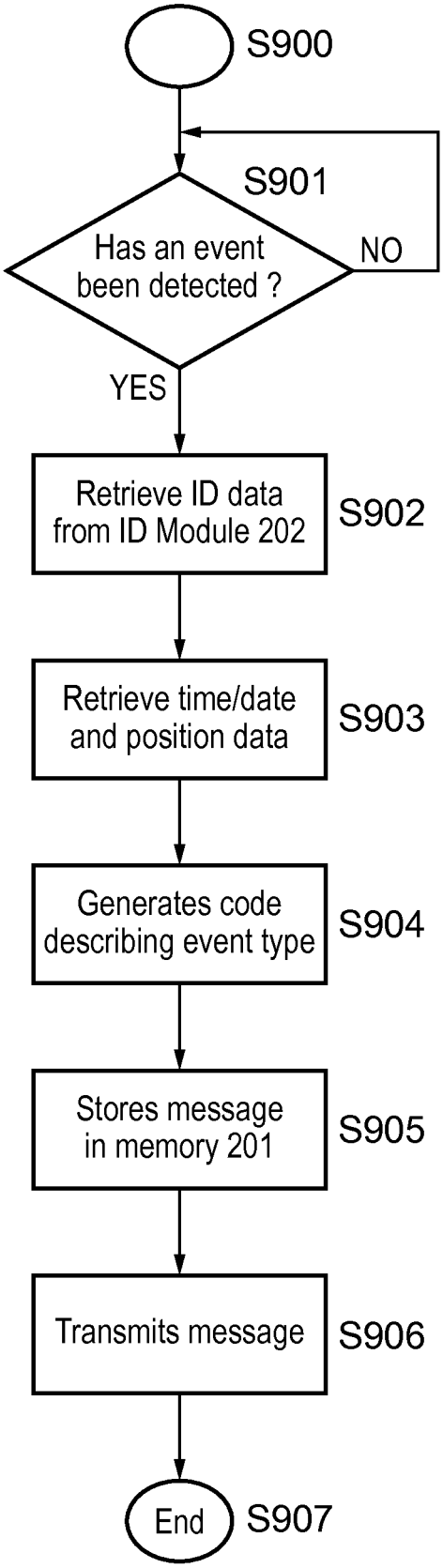
FIG. 9: Exemplary flow diagram describing message generation by an on-board node.

FIG. 9 shows an exemplary flow diagram describing message generation by the processing and communication unit 120. The flow starts at step S900, remaining at step S901 until an event is detected by any of the on-board sensors 102, 103, 104, 105, 106 and 107 or until an emergency is signalled by the processing unit 200 (such as engine fire) or by the panic button 109. Once an event is detected the processing unit 200 retrieves ID data from ID module 202 at step S902 if the module has been enabled, otherwise the processing unit 200 adds a random code that uniquely identifies the vehicle while maintaining its anonymity. The random code is preferably generated only once (for example when commissioning the processing and communication unit 120) and remains unchanged thereafter.

The flow then continues at step S903, where the processing unit 200 retrieves position data from memory 201 as well as date and time information. The processing unit 200 then generates a short numeric code identifying the type of event (e.g. collision, sudden deceleration, erratic driving, etc.) and its associated priority at step S904; once this happens a message is assembled and stored in memory 201 at step S905, with the message being transmitted at step S906. Transmission of the message may or may not be received, depending on which other nodes if any may be in range. To ensure successful transmission, the message may be added to those considered in the protocol according to FIG. 8, so as to be retransmitted every T seconds for the duration of the time L. The flow then terminates at step S907.

Thus, to summarize, embodiments of the present invention provide a vehicular safety system that hinges on an adaptive epidemic information dissemination protocol running on a wireless ad-hoc network composed by neighboring vehicles and roadside stations. The protocol is based on collaborative storage and re-transmission of messages by on-board units in vehicles; both storage time and re-transmission period of messages are adaptively adjusted in order to make information spread through the network reasonably certain. The on-board system monitors amongst other parameters a vehicle's speed and acceleration in order to detect collisions or any other situation that might endanger road users or compromise the safety of driver and passengers; when such an event is detected a short time-stamped message that optionally identifies the vehicle and that contains its approximate location and the type of event is transmitted. A panic button is included to trigger an emergency message in case of situations that represent an immediate threat to the physical integrity of driver and passengers. Roadside stations add their location to the messages they relay, making satellite or map-based positioning technologies unnecessary; they also receive messages transmitted from passing vehicles, relaying them to law-enforcement agencies. Roadside stations can also broadcast messages aimed at locating and safely disabling stolen vehicles.

Various modifications are possible within the scope of the invention.

Although an embodiment has been described with reference to a vehicle in the form of a car, the present invention is not restricted to such use and may be applied to any kind of road vehicle. Similarly, whilst the present invention is most applicable to vehicles driven on the public road network, the present invention is not necessarily restricted to such use.

As will be apparent from the above description, the vehicle nodes, broadcasting nodes and listening nodes form an ad-hoc network, the structure of which will change as the vehicles move around. There is no particular limit to the size of network capable of being generated in this way; however, from the perspective of an individual message, the retransmission time L will tend to provide a natural limit, as this defines an effective lifetime for each message which will limit their geographical spread. In addition, the broadcasting nodes are preferably supplied by the control centre with warning messages, etc., relevant to the vicinity of that node and not with messages only of interest to vehicles around far-away nodes.

Any of the embodiments and variations mentioned above may be combined in the same system. Features of one embodiment may be applied to any of the other embodiments.

In any of the aspects or embodiments of the invention described above, the various features may be implemented in hardware, or as software modules running on one or more processors.

The invention also provides a computer program or a computer program product for carrying out any of the methods described herein, and a computer readable medium having stored thereon a program for carrying out any of the methods described herein.

A computer program embodying the invention may be stored on a computer-readable medium, or it may, for example, be in the form of a signal such as a downloadable data signal provided from an Internet website, or it may be in any other form.

It is to be understood that various changes and/or modifications may be made to the particular embodiments just described without departing from the scope of the claims.

INDUSTRIAL APPLICABILITY

The technological field that this invention belongs to is intelligent transportation systems. By alerting traffic authorities and road users about situations that compromise driver and passenger safety, break the law or generate a road hazard such as stolen/hijacked vehicles, dangerous driving, burning vehicles or collisions, the present invention can contribute to improving road safety, and to improving traffic flow and traffic network management.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A processing and communication unit for a vehicle, comprising:

detectors adapted to detect one or more states of the vehicle;

a control unit adapted to generate messages based on the states detected;

a transceiver adapted to transmit messages at least to other vehicles and receive messages at least from the other vehicles in an ad-hoc network; and a memory adapted to temporarily store generated and received messages;

wherein the processing and communication unit is configurable with a retransmission interval at which to repeat transmission of the same messages, and a retransmission time after which to cease retransmission, the retransmission interval and retransmission time being adaptively adjusted in the ad-hoc network in accordance with driving conditions of the vehicles to ensure spread of the messages through the network.

2. The processing and communication unit according to claim 1, wherein the memory is arranged to store messages for a retransmission time with which the processing and communication unit has been configured.

3. A vehicle equipped with the processing and communication unit of claim 1.

4. An ad-hoc transmission method for vehicle safety information, comprising:

constituting nodes of an ad-hoc network from a plurality of vehicles operating in a geographical area for transmitting and re-transmitting messages, and adjusting operating parameters of the ad-hoc network adaptively in accordance with driving conditions of the plurality of vehicles, wherein the operating parameters being adjusted include a retransmission interval at which to repeat transmission of the same messages and;

a retransmission time after which to cease retransmission, the retransmission interval and the retransmission time being adaptively adjusted to ensure spread of the messages through the ad-hoc network; and wherein the driving conditions of the plurality of vehicles include at least one of:

one of a time of day and a day of the week;

a type of road on which a vehicle is being driven; and whether the vehicle is parked.

* * * * *